US007605325B2

(12) United States Patent
Ito

(10) Patent No.: US 7,605,325 B2
(45) Date of Patent: Oct. 20, 2009

(54) ELECTRIC STRINGED INSTRUMENT

(75) Inventor: Osamu Ito, Tokyo (JP)

(73) Assignee: Yamaha Corporation, Shizuoka (JP)

( * ) Notice: Subject to any disclaimer, the term of this patent is extended or adjusted under 35 U.S.C. 154(b) by 50 days.

(21) Appl. No.: 11/331,675

(22) Filed: Jan. 13, 2006

(65) Prior Publication Data

US 2006/0174755 A1 Aug. 10, 2006

(30) Foreign Application Priority Data

Jan. 19, 2005 (JP) ..... 2005-011734

(51) Int. Cl.
*G10H 1/06* (2006.01)
*A63J 17/00* (2006.01)

(52) U.S. Cl. ..... 84/735; 84/464 A

(58) Field of Classification Search ..... 84/464 R, 84/464 A, 735
See application file for complete search history.

(56) References Cited

U.S. PATENT DOCUMENTS 4,563,933 A * 1/1986 Kim ..... 84/267
5,796,025 A * 8/1998 Haake ..... 84/464 R
5,866,834 A * 2/1999 Burke et al. ..... 84/622
5,932,827 A * 8/1999 Osborne et al. ..... 84/726

FOREIGN PATENT DOCUMENTS

JP 2001-013967 1/2001
JP 2003-099038 4/2003

* cited by examiner

*Primary Examiner*—Jeffrey Donels
(74) *Attorney, Agent, or Firm*—William L. Androlia; H. Henry Koda

(57) ABSTRACT

A display device that displays a selected pickup is provided in a volume control that adjusts the volume of a performance. The display device is formed by a light guiding body, and by two types of LED that emit light in different colors, for example, a green LED and a blue LED, and are packaged on a printed circuit board. The green LED is turned on when the front pickup on the neck side is selected, so that a display portion on the light guiding body is displayed in green. In contrast, the blue LED is turned on when the rear pickup on the bridge side is selected, so that the display portion is displayed in blue. When both pickups are selected, both LED are turned on so that the display portion is displayed in both green and blue or in a combination of these colors (i.e., in cyan).

4 Claims, 5 Drawing Sheets

ELECTRIC STRINGED INSTRUMENT

BACKGROUND OF THE INVENTION

Priority is claimed on Japanese Patent Application No. 2005-11734, filed Jan. 19, 2005, the contents of which are incorporated herein by reference.

1. Field of the Invention

The present invention relates to an electric stringed instrument such as an electric guitar or an electric bass guitar that plays music by detecting vibrations from strings and converting them into electrical signals.

2. Description of Related Art

Conventionally, in an electric guitar, a plurality of types of pickup devices (referred to below as pickups) that each have a different tone are lined up below the strings in parallel with the direction in which the strings extend. Vibrations from the strings are detected by these pickups and are converted into electrical signals. These are then amplified and played from a speaker. There are three types of pickup. A pickup that is normally placed on a front side (i.e., a neck side) is known as a front pickup, a pickup that is placed on a rear side (i.e., a bridge side) is known as a rear pickup, and a pickup that is placed between these two is known as a center pickup. When the front pickup is selected and used, a soft sound is generated. When the rear pickup is selected and used, a hard sound is generated. When both pickups are selected and used, an intermediate sound is generated. The selection of which of these pickups is used is made using a pickup selecting device (referred to below as a selector), and, if required by the piece being played, a mixed sound (i.e., a half tone) can be obtained by using the front pickup and center pickup together or the center pickup and the rear pickup together.

A conventional technology that makes it possible to display which pickup has been selected by the selector is described in Japanese Unexamined Patent Application, First Publication, (JP-A) No. 2001-13967.

In the conventional technology described in JP-A No. 2001-13967, a pickup display device is provided in the guitar body and this display device displays which of the front, middle, and rear pickups is currently being used. An LED or liquid crystal panel is used for the pickup display device.

However, in the conventional technology described in JP-A No. 2001-13967, because no special measures are provided in order to improve the ability to identify or improve the ability to verify the pickup on the pickup display device, the display state is monotone (i.e., a monochrome display) and there is little variety of change so that the device is lacking in its verifiability and in its appearance or design as an instrument. Moreover, outside where illumination is poor or during a performance on a stage, the problem arises that it is not possible to identify which pickup has been selected, so that there is considerable scope for improvement.

SUMMARY OF THE INVENTION

The present invention has been conceived in order to solve the above described conventional problems, and it is an object thereof to provide an electric stringed instrument that makes it possible to improve the verifiability or identifiability of a selected pickup, and to improve the degree of freedom regarding the position where the display device can be installed.

In order to achieve the above described objects, the present invention includes: a plurality of pickup devices that detect vibrations from respective strings and convert the vibrations into electrical signals; and a display device that displays a selection state of each pickup device and is formed by a plurality of light sources that each emits a different color light associated with each of the pickup devices.

Moreover, in the present invention, the light sources may be LEDs, and the display device may be further provided with a light guiding body that has a display portion that is provided at a perimeter of an operating part and to which light from the LED is guided.

Moreover, in the present invention, the light sources may be LEDs, and the display device may display each pickup device in a different color.

The present invention according to another aspect includes: a plurality of pickup devices that detect vibrations from respective strings and convert the vibrations into electrical signals; and a display device that displays a selection state of each pickup device, and is formed by a color liquid crystal panel that displays a different display color for each pickup device.

Moreover, in the present invention, the color liquid crystal panel may be provided at a perimeter of an operating part.

Moreover, in the present invention, the color liquid crystal panel may be provided in each pickup device and may display a different color.

Furthermore, in the present invention, the operating part may be at least one of a pickup device selecting control, a volume adjusting control, and a tone adjusting control.

In the present invention, because the light sources of the display device display the selection state of each pickup device in a different display color (i.e., emission color), the identifiability and verifiability of the selected pickup device is improved as well as the design of the instrument, compared with when they are displayed using the same color. For example, when the front pickup is selected, a display is made using a green color, while when the rear pickup is selected, a display is made using a blue color, and if both pickups are selected, a display is made using both a green and a blue color or using a combination of these colors (i.e., a cyan color).

Moreover, because the display colors are different, the display device can be installed in a suitable location even away from the pickup devices, so that the degree of freedom that can be employed when installing the display device is improved.

Furthermore, including those display devices that are incorporated into the pickup devices, these display devices can be made to directly display each pickup device in a different display color.

It is also possible for the display portion of the light guiding body to which light from the LED is guided to be provided at a circumferential edge of an operating part, so that a wider area than the display area of the LED can be displayed.

It is also possible for the operating part that is the subject of a display by the display device to be any one or any optional two or more of the pickup selecting control, the volume adjusting control, and a tone adjusting control.

DETAILED DESCRIPTION OF THE INVENTION

Preferred embodiments of the present invention will now be described in detail with reference to the drawings.

Figure 1:
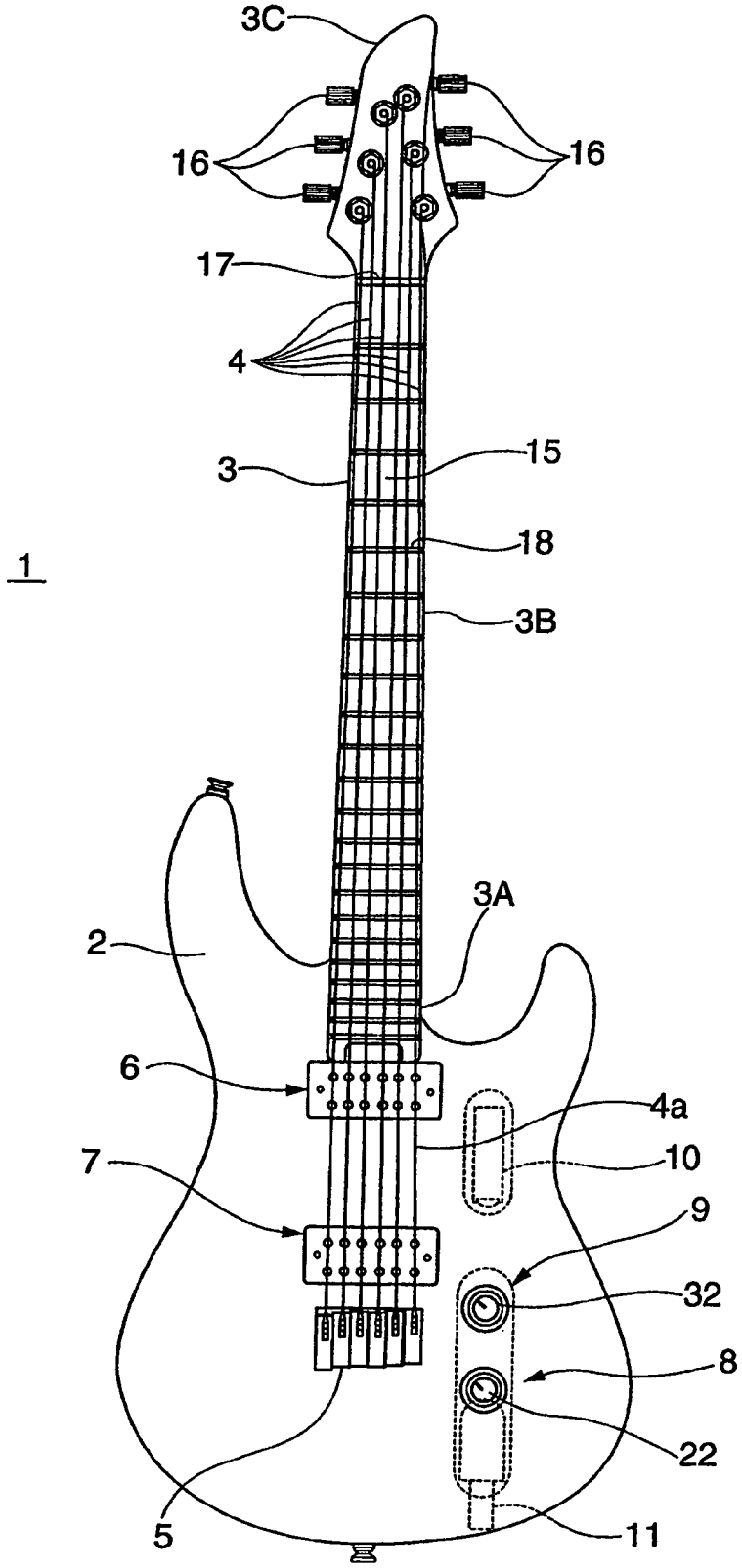
FIG. 1 is a frontal view showing an electric guitar according to a first embodiment of the present invention.

FIG. 1 is a frontal view showing a first embodiment when the present invention is applied to an electric guitar.

In FIG. 1, an electric guitar whose overall shape is indicated by the symbol 1 is provided with a solid type (or semi acoustic type) of body 2 and neck 3 and these two components form a musical instrument body. A bridge 5 that supports one end of six strings 4, two types of pickup device (referred to below as pickups) 6 and 7 that detect vibrations from each string 4 and convert them into electrical signals, and two operating parts 8 and 9 are positioned on a front surface side of the body 2. A power supply (i.e., a dry cell) 10 is incorporated inside the body 2, and a jack 11 that feeds electrical signals from the respective pickups 6 and 7 to the outside is mounted on a circumferential surface on a hip side of the body 2.

The pickup 6 that is positioned on the base end side of the neck 3 is referred to as the front pickup, while the pickup 7 that is positioned adjacent to the bridge 5 is referred to as the rear pickup. In the present embodiment, an example is shown in which a humbucking type of electromagnetic pickup that has excellent noise deleting properties is used for the front pickup 6 and the rear pickup 7. However, the present invention is not limited to this and it is also possible for a single coil type of electromagnetic pickup to be used.

The neck 3 is formed by a base end portion 3A that is formed comparatively thickly and is joined to a front end of the body 2, a bar portion 3B that is formed integrally with the base end portion 3A and extending forwards therefrom, and a head portion 3C that is formed integrally with a distal end of the bar portion 3B. A fingerplate 15 is joined to a surface of the base end portion 3A and bar portion 3B of the neck 3, and six tuning keys 16 that anchor end portions of the strings 4 that are on the opposite side from the bridge 5 are mounted on the head portion 3C. A top bridge 17 that supports a portion of the neck side end of each string 4 and a plurality of frets 18 that determine musical intervals are embedded in the surface of the fingerplate 15.

The operating part 8 forms a pickup selecting device (referred to below as a selector) that selects one or both of the two pickups 6 and 7. The other operating part 9 forms a volume regulating device (referred to below as a volume) that regulates the volume of the electric guitar 1. The selector 8 and the volume 9 are positioned on the surface of the body 2 where a guitar player can easily operate them using a finger of the hand holding a pick (i.e., the right hand) during a performance. Specifically, the selector 8 and the volume 9 are provided on a right side of a first string 4*a* and so as to be adjacent to the vicinity of both the rear pickup 7 and the bridge 5.

Figure 2:
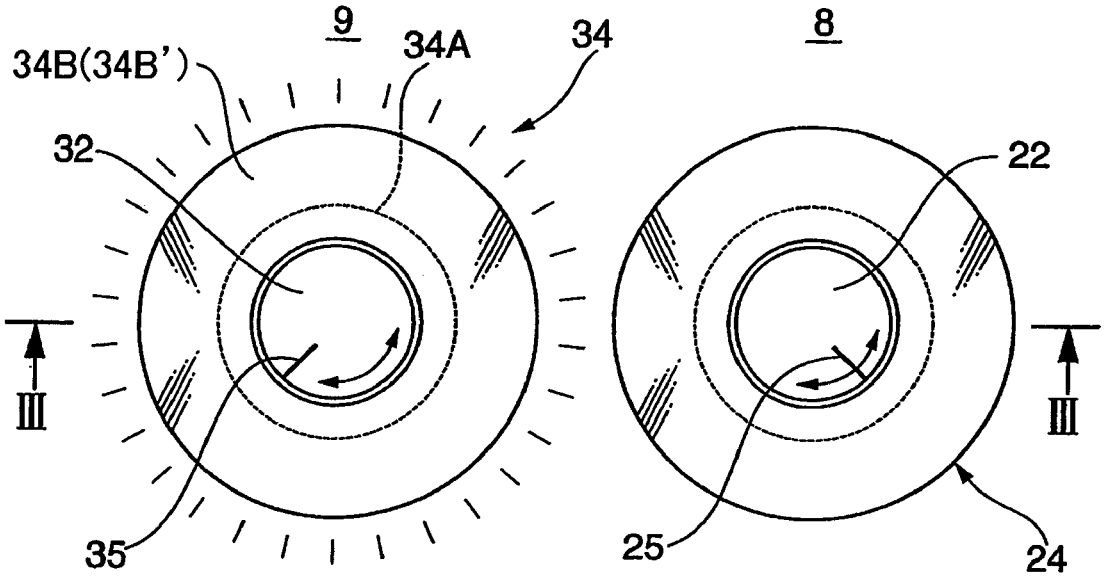
FIG. 2 is a plan view showing a selector and a volume control used in the first embodiment of the present invention.
Figure 3:
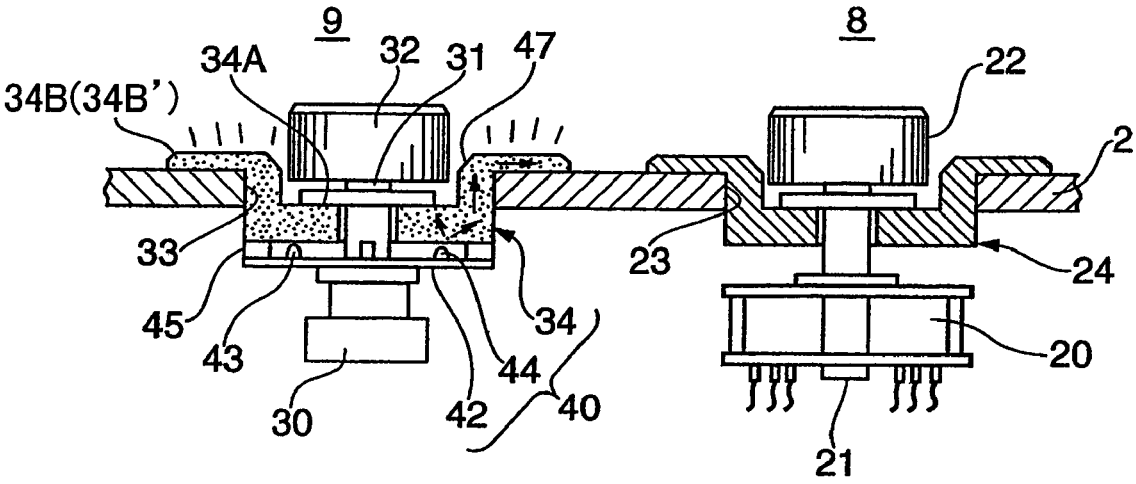
FIG. 3 is a cross-sectional view taken along a line III-III in FIG. 2.
Figure 4:
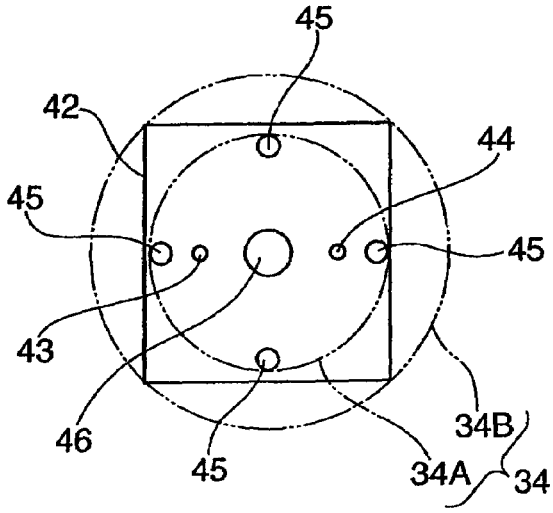
FIG. 4 is a plan view showing a printed circuit board, on which LEDs are mounted, used in the first embodiment of the present invention.

Referring to FIGS. 2 to 4, the selector 8 is formed by a rotating type of transfer switch that has a switch body 20 having a rotation shaft 21, and a dial 22 that is attached to a distal end of the rotation shaft 21. The selector 8 is mounted via a mounting member 24 in a mounting hole 23 that is provided in the surface of the body 2. The rotation shaft 21 penetrates an insertion hole that is formed in the mounting member 24, and the dial 22 is made to protrude from the surface side of the body 2. An indicator 25 is displayed on the surface of the dial 22. This selector 8 is constructed such that, when the dial 22 is rotated to the left or right by hand, the pickup 6 or 7 is selected and the selection state thereof is electrically switched. In this case, the selector 8 is able to switch between three types of mode, namely, a front pickup 6 selection mode, a rear pickup 7 selection mode, and a double pickup 6 and 7 selection mode. Note that the electrical circuit of the selector 8 will be described below with reference to FIG. 5.

The volume 9 is formed by a rotating type of variable resistor that has a resistor body 30 having a rotation shaft 31, and a dial 32 that is attached to a distal end of the rotation shaft 31. The volume 9 is also mounted via a mounting member 34 in a mounting hole 33 that is provided in the surface of the body 2. The rotation shaft 31 penetrates an insertion hole that is formed in the mounting member 34, and the dial 32 is made to protrude from the surface side of the body 2. An indicator 35 is displayed on the surface of the dial 32. When the dial 32 is rotated by hand to the left or right, the resistance value of the resistor body 30 changes so that the volume of the electric guitar 1 is adjusted. The above described structure is the same as in a typical conventional electric guitar.

Furthermore, a display device 40 is provided as a display mode 1 in the volume 9 to switch and display the selection (i.e., usage) state of the pickups 6 and 7. This display device 40 is formed by a printed circuit board 42, two types of LED (i.e., light sources) 43 and 44 having different emission colors that are packaged on the printed circuit board 42, and the aforementioned mounting member 34.

The printed circuit board 42 is mounted via a spacer 45 to a bottom surface of the mounting member 34, and a through hole 46 through which passes the rotation shaft 31 of the volume 9 is formed in the center of the printed circuit board 42.

The LED 43 and 44 are preferably formed on a concentric circle that is centered on the through hole 46, and separated by approximately 180° in the circumferential direction. The colors emitted by the LED 43 and 44 may, for example, be green and blue (the LED may be referred to below as a green LED and a blue LED). In this case, an example is described in which one LED 43 and one LED 44 are used, however, in cases when there is irregular illumination when the LED are turned on, a plurality of LED may be used for each of the LED 43 and 44, and these may be arranged in a concentric circle around the through hole 46.

The mounting member 34 is formed in the shape of a cup having a brim from a transparent resin such as an acrylic resin. Accordingly, the mounting member 34 is formed by a body 34A that is shaped as a cylinder that has one end closed off that is fitted into the mounting hole 33 in the body 2, and by a display section 34B that is formed integrally with, and so as to protrude from, an outer circumferential surface of the aperture end side of the body 34A and that is shaped like a circular plate that covers circumferential edge portions of the mounting hole 33 on the surface of the body 2. The body 34A has a through hole in the bottom surface thereof that is penetrated by the rotation shaft 31, and the dial 32 is placed inside this through hole. A reflective surface 47 that is inclined at an angle of substantially 45° is formed around the entire circumference on an inner circumferential surface side of an edge of an aperture of the body 34A. This reflective surface 47 reflects light from the LED 43 and 44 that has entered the body 34A in the direction of the display portion 34B. Namely, the mounting member 34 is used as a light guiding body that guides the light from the LED 43 and 44 towards the surface of the dial 32 in order to display the perimeter of the dial 32 in the colors emitted by the LED 43 and 44. Accordingly, in the description below, the mounting member 34 is referred to as a light guiding body 34. Note that it is preferable for a satin finishing or the like to be implemented on the rear surface side of the display portion 34 in order for light from the LED 34 and 44 to be diffused and reflected to the front surface side. Moreover, it is also possible for the light guiding body 34 to be sufficiently transparent that light emitted from the LED 34 and 44 is able to pass therethrough, and it may be formed from a material such as rubber that has elasticity. If rubber is used, this has far superior anti-breaking properties than plastic or glass.

Figure 5:
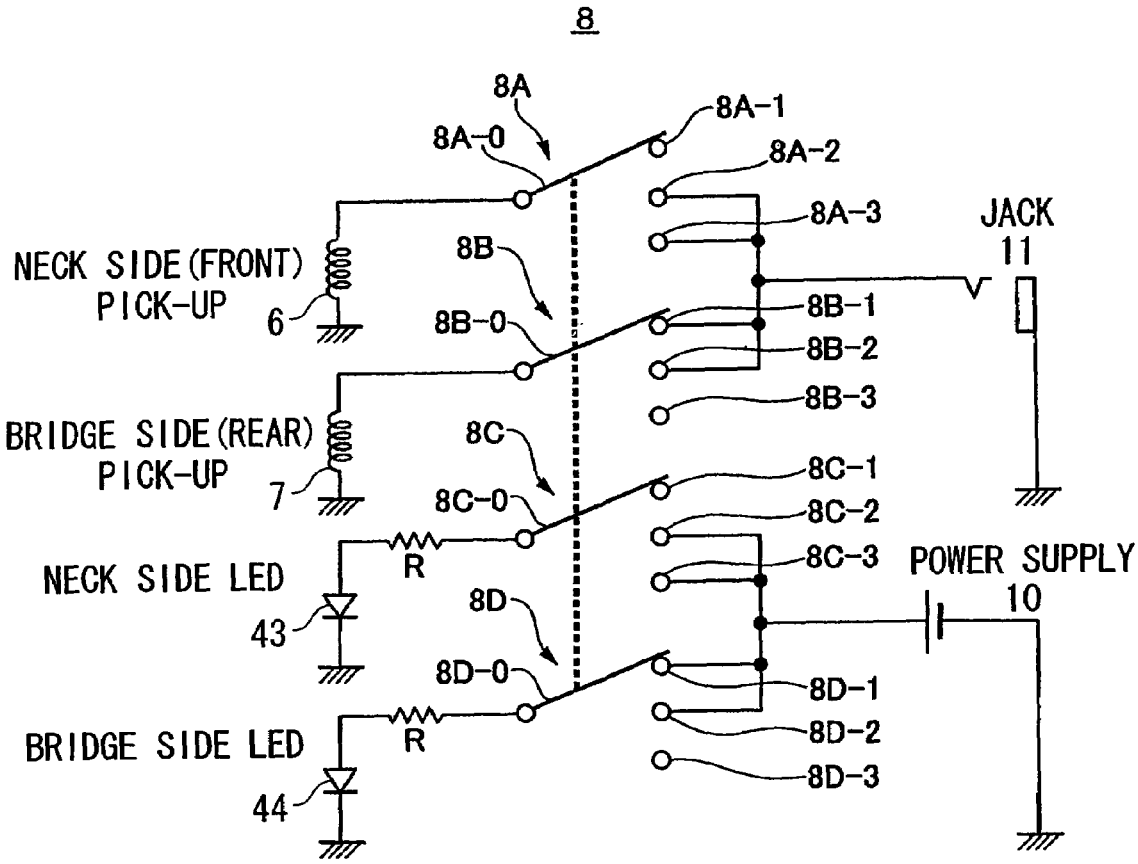
FIG. 5 is an electrical circuit diagram showing an operation of a pickup selector and LEDs used in the first embodiment of the present invention.

In FIG. 5, the selector 8 is provided with first through fourth switch sections 8A to 8D that each have the same structure. These switching sections 8A to 8D perform in synchronization the switching between selecting the pickup 6 and selecting the pickup 7 and the switching between ON and OFF of the LED 43 and 44. The first through fourth switch sections 8A to 8D have three fixed junction points 8A-1 to 8A-3, 8B-1 to 8B-3, 8C-1 to 8C-3, and 8D-1 to 8D3, that are each selected by one movable junction point 8A-0 to 8D-0. Each of the movable junction points 8A-0 to 8D-0 of the switch sections 8A to 8D are operated manually in synchronization. Moreover, the movable junction points 8A-0 to 8B-0 of the first and second switch sections 8A and 8B are respectively connected to the front pickup 6 on the neck side and the rear pickup 7 on the bridge side. The movable junction points 8C-0 to 8D-0 of the third and fourth switch sections 8C and 8D are respectively connected via resistors R to the LED 43 and the LED 44. The second and third fixed junction points 8A-2 and 8A-3 of the first switch section 8A and the first and second fixed junction points 8B-1 and 8B-2 of the second switch section 8B are connected to one connection point of the jack 11. In addition, the second and third fixed junction points 8C-2 and 8C-3 of the third switch section 8C and the first and second fixed junction points 8D-1 and 8D-2 of the fourth switch section 8D are connected to the power supply 10. Note that the first fixed junction points 8A-1 and 8C-1 of the first and third switch sections 8A and 8C and the third fixed junction points 8B-3 and 8D-3 of the second and fourth switch sections 8B and 8D are all unconnected and are left open.

Figure 6A:
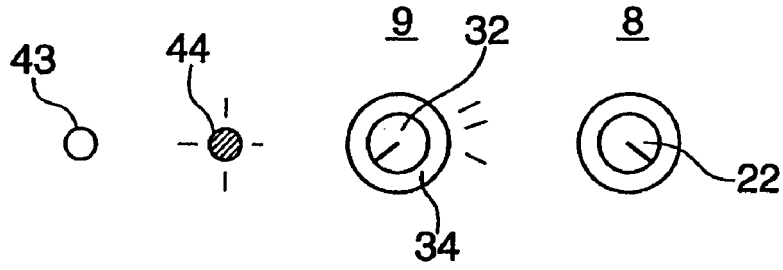
FIGS. 6A to 6C are schematic views showing an operation of LEDs in response to the pickup selector used in the first embodiment of the present invention.

FIGS. 5 and 6A show a state when the rear pickup 7 is selected by the switching of the selector 8 in an electric guitar 1 having this type of structure. In this selection state, the movable junction point 8A-0 of the first switch section 8A is in contact with the first fixed junction point 8A-1, the movable junction point 8B-0 of the second switch section 8B is in contact with the first fixed junction point 8B-1, the movable junction point 8C-0 of the third switch section 8C is in contact with the first fixed junction point 8C-1, and the movable junction point 8D-0 of the fourth switch section 8D is in contact with the first fixed junction point 8D-1.

Accordingly, if any of the strings 4 is played with a pick, the vibrations from that string 4 are detected by the rear pickup 7 and are converted into electrical signals. These are then amplified by an amplifier and output as electronic sounds from a speaker.

If the rear pickup 7 is selected, the LED 44 of the display device 40 is turned on. When light from the LED 44 strikes the inside of the light guiding body 34, a portion thereof strikes the reflective surface 47 and is reflected. It is subsequently guided to the display section 34B. Because of this, the display section 34B is displayed in blue, which is the color of the light emitted by the LED 44, and, as a result, the fact that the rear pickup 7 has been selected is displayed.

Figure 6B:
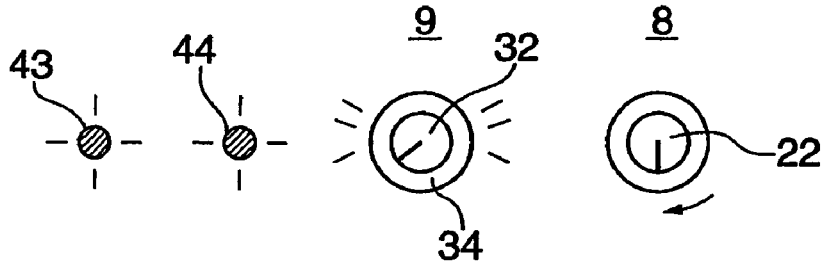

Next, when a switch is made from a state in which the rear pickup 7 is selected to a state in which the front pickup 6 and the rear pickup 7 are both selected and used, the dial 22 of the selector 8 is operated by the player's finger, and is switched from the state shown in FIG. 6A to the state shown in FIG. 6B in which the dial has been rotated by a predetermined angle (45°) in a clockwise direction. If the dial 22 is rotated by a predetermined angle, the movable junction points 8A-0 to 8D-0 of the first through fourth switches 8A to 8D make contact respectively with the second fixed junction points 8A-2 to 8D-2. As a result, the front pickup 6 and the rear pickup 7 are both selected, and vibrations from the strings 4 are detected and converted into electrical signals.

When the front pickup 6 and the rear pickup 7 are selected, both the LED 43 and the LED 44 are turned on, and the light therefrom enters the light guiding body 34. A portion of this light strikes the reflective surface 47 and is reflected so as to be guided to the display section 34B. As a result, the display section 34B is displayed in green and blue, which are the colors of the light emitted by the LED 43 and 44, so that the fact that both the front pickup 6 and the rear pickup 7 are selected is displayed. In this case, both green and blue are displayed as the display colors of the display section 34B, however, depending on the number and placement of the LED 43 and 44 and on the size of the display section 34B and the like, it is also possible for a cyan color to be displayed which is a combination of green and blue.

Figure 6C:
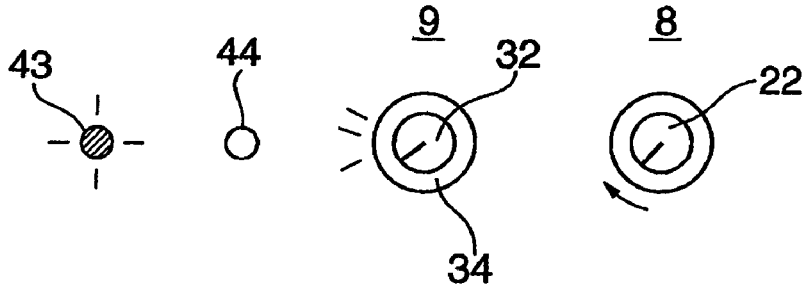

Next, when a switch is made from a state in which both the front pickup 6 and the rear pickup 7 are selected to a state in which the front pickup 6 is selected and used, the dial 22 of the selector 8 is switched from the state shown in FIG. 6B to the state shown in FIG. 6C in which the dial has been further rotated by a predetermined angle (45°) in a clockwise direction. If the dial 22 is rotated by a predetermined angle, the movable junction points 8A-0 to 8D-0 of the first through fourth switches 8A to 8D make contact respectively with the third fixed junction points 8A-3 to 8D-3. As a result, the front pickup 6 is selected, and vibrations from the strings 4 are detected and converted into electrical signals.

In the front pickup 6 selection mode, the LED 43 is turned on and the light therefrom enters the light guiding body 34. A portion of this light strikes the reflective surface 47 and is reflected so as to be guided to the display section 34B. As a result, the display section 34B is displayed in green, which is the color of the light emitted by the LED 43, so that the fact that the front pickup 6 is selected is displayed.

In the present invention that has the above described structure, because the two LED 43 and 44 that emit light of different colors are used, and either one of the LED 43 and 44 is turned on or else both are turned on in accordance with the selection mode of the pickups 6 and 7 so that the display color of the display section 34B of the light guiding body 34 can be varied, it is possible to reliably confirm which pickup has been selected from this display color.

Moreover, if a color display (i.e., identification) portion that has been matched in advance with an LED color is provided in each of the pickups 6 and 7, then it is possible to visually confirm which pickup has been selected from the color of the LED of the display device that is emitting light, resulting in an increased visual confirmation effect becoming possible. For example, a green identification portion may be provided adjacent to the front pickup 6, a blue identification portion may be provided adjacent to the rear pickup 7, and a cyan identification portion may be provided near the middle between the front pickup 6 and the rear pickup 7. This would make it easy to understand which pickup corresponded to the color being emitted from the light guiding body. In addition, the identification portion may be an LED that is always on, or may be a component having an identification color, or may be provided by adhering a sample color seal or the like thereto.

Furthermore, according to the present invention, because it is only necessary to confirm which color is being displayed, it is not essential for the display device 40 to be located adjacent to the pickups 6 and 7, and it is possible to improve the degree of freedom that can be employed when considering the placement of the display device 40.

Here, in the present embodiment, an example is described in which the two LED 43 and 44 that each emit a different color and the light guiding body 34 are provided in the volume 9 as a display mode 1 that switches between and displays the selection state of the pickups 6 and 7, and the perimeter of the dial 32 is displayed in different display colors by guiding light from the LED 33 and 34 to the display section 34B of the light guiding body 34, however, the present invention is not limited to this and it is possible for various display modes to be employed. Examples of these display modes are given below.

Display Mode 2

The volume 9 and a tone adjusting device (referred to below as the tone) are provided on both sides of the selector 8. The volume 9 is on the neck side, the tone is on the bridge side, and the selector 8 is between the volume 9 and the tone. Instead of the volume 9, the display device 40 that displays the selection state of the pickups 6 and 7 is provided in the selector 8 or tone, and the perimeter of this dial is displayed in a display color that varies in accordance with selection state of the pickups 6 and 7. Note that because the tone, like the volume 9, is formed by a rotating variable resistor, it is not shown in the drawings, however, in FIG. 3, the display device 40 on the volume 9 side may be removed and a tone that has the same structure as the volume 9 and is provided with a display device 40 may be provided on the right side of the selector 8.

Display Mode 3

A display device 40 is provided in all of the selector 8, the volume 9, and the tone, and the perimeters of the dials thereof may be displayed in display colors, for example, green and blue, that vary in accordance with the selection state of the pickups 6 and 7. In this case, the display examples 1 to 4 given below may be considered as examples of displays by the display device 40.

DISPLAY EXAMPLE 1

(1) When the front pickup 6 is selected; the green LED 43 of the display devices 40 of the selector 8, volume 9, and tone are all turned on.

(2) When the rear pickup 7 is selected; the blue LED 44 of the display devices 40 of the selector 8, volume 9, and tone are all turned on.

(3) When the front pickup 6 and the rear pickup 7 are selected; the green LED 43 and the blue LED 44 of the display devices 40 of the selector 8, volume 9, and tone are all turned on.

DISPLAY EXAMPLE 2

(1) When the front pickup 6 is selected; only the green LED 43 of the display device 40 of the volume 9 is turned on (i.e., the LED of the display devices of the selector 8 and the tone are all turned off).

(2) When the rear pickup 7 is selected; only the blue LED 44 of the display device 40 of the tone is turned on (i.e., the LED of the display devices of the selector 8 and the volume 9 are all turned off).

(3) When the front pickup 6 and the rear pickup 7 are selected; the green LED 43 and the blue LED 44 of the display device 40 of the selector 8 are turned on (i.e., the LED of the display devices of the volume 9 and the tone are all turned off).

According to display example 2, because the position (i.e., the layout) of the selected pickup corresponds to the position of the turned-on operating part, it is possible to visually confirm which pickup has been selected not only from the display color, but also from the position where a light has been turned on.

By employing a structure in which the position (i.e., the layout) of the selected pickup corresponds to the position of the turned-on operating part so that it is possible to visually confirm which pickup has been selected, it is not essential to employ different color displays, and it is possible to provide displays using the same color (i.e., monochrome).

DISPLAY EXAMPLE 3

(1) When the front pickup 6 is selected; the green LED 43 of the display devices 40 of the selector 8, volume 9, and tone are all turned on and, of these, the green LED 43 of the display device of the volume 9 is more brightly illuminated than the other green LED. Namely, of the three display devices 40, the green LED of the display device on the neck side is more brightly illuminated.

(2) When the rear pickup 7 is selected; the blue LED 44 of the display devices 40 of the selector 8, volume 9, and tone are all turned on and, of these, the blue LED of the display device of the tone is more brightly illuminated than the LED of the other display devices. Namely, of the three display devices 40, the blue LED of the display device on the bridge side is more brightly illuminated.

(3) When the front pickup 6 and the rear pickup 7 are selected; the green LED 43 and the blue LED 44 of the display devices 40 of the selector 8, volume 9, and tone are all turned on and, of these, the green LED and the blue LED of the display device of the selector 8 are more brightly illuminated than the LED of the other display devices. Namely, of the three display devices 40, the green LED and the blue LED of the center display device are more brightly illuminated.

According to display example 3, because the position (i.e., the layout) of the selected pickup corresponds to the position of the brightly illuminated operating part, it is possible to visually confirm which pickup has been selected not only from the display color, but also from the position where a light is brightly illuminated.

By employing a structure in which the position (i.e., the layout) of the selected pickup corresponds to the position of the brightly illuminated operating part so that it is possible to visually confirm which pickup has been selected, it is not essential to employ different color displays, and it is possible to provide displays using the same color (i.e., monochrome).

DISPLAY EXAMPLE 4

(1) When the front pickup 6 is selected; the green LED 43 of the display devices 40 of the tone, selector 8, and volume 9 are all sequentially turned on in this order. Namely, in the three display devices, the green display color moves as if flowing from the rear side to the front side.
(2) When the rear pickup 7 is selected; the blue LED 44 of the display devices 40 of the volume 9, selector 8, and tone are all sequentially turned on in this order. Namely, in the three display devices, the blue display color moves as if flowing from the front side to the rear side.
(3) When the front pickup 6 and the rear pickup 7 are selected; firstly, the green LED 43 and blue LED 44 of the display devices 40 of the volume 9 and tone are turned on and, next, the green LED 43 and the blue LED 44 of the display device 40 of the selector 8 are turned on. Namely, in the three display devices 40, the display colors move as if flowing towards the center from the front and rear.

According to display example 4, because the position (i.e., the layout) of the selected pickup corresponds to the position (i.e., in the illumination sequence) of the operating part that is turned on last, it is possible to visually confirm which pickup has been selected not only from the display color, but also from the sequence in which the lights are turned on.

By employing a structure in which the position (i.e., the layout) of the selected pickup corresponds to the position of the operating part that is illuminated last (i.e., in the illumination sequence) so that it is possible to visually confirm which pickup has been selected, it is not essential to employ different color displays, and it is possible to provide displays using the same color (i.e., monochrome).

Other display modes include flashing the LED 43 and 44 on and off. The display mode in this case may be achieved by replacing the illuminated state in the above described display modes 1 to 3 with a flashing state. It is also possible for the LED 43 and 44 to be turned off after a predetermined time has lapsed from when they were turned on.

In particular, in the case of display example 4 from among the above described display modes, it is also possible after each LED has been turned on in sequence for them to then all be turned off and then once again turned on in sequence so that a display that appears to flow is repeated. Alternatively, it is also possible, after the LED have all been turned on in sequence, for only the LED that was turned on last to then be left on while the other LED are all turned off. By employing this type of structure, after a brief pause after the pickup selection operation, it is possible to visually confirm which pickup has been selected.

Figure 7:
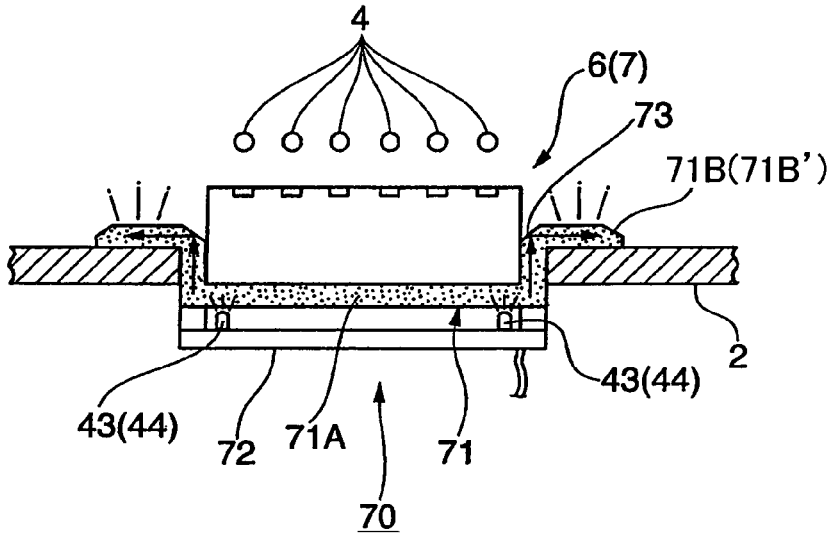
FIG. 7 is a cross-sectional view showing a front pickup according to a second embodiment of the present invention.

FIG. 7 is a cross-sectional view of a front pickup that shows a second embodiment of the present invention.

In this embodiment, display devices 70 that each emit light of a different color are provided in the front pickup 6 and the rear pickup 7, and the pickup 6 and the pickup 7 are made to provide a direct display in different display colors. Note that, because the rear pickup 7 has the same structure as the front pickup 6, a description thereof is omitted.

The display device 70 that is provided in the front pickup 6 is formed by a light guiding body 71 and a plurality of LED 43 that emit, for example, light in a green color and are packaged on a printed circuit board 72. The light guiding body 71 is formed by a narrow elongated box-shaped body 71A that is provided with a bottom and that houses the front pickup 6, and a rim-shaped display portion 71B that is provided integrally with an aperture edge of the body 71A. A reflective surface 73 that is made up by an inclined surface is formed at an inner circumferential surface of the aperture edge of the body 71A. This light guiding body 71 differs from the light guiding body 34 in its size and configuration only and the remaining structure as well as the functions thereof are identical thereto.

The display device 70 that is provided in the rear pickup 7 is different from the display device 70 provided in the front pickup 6 in that, for example, LED 44 that emit light, for example, in a blue color are used.

In the above described embodiment, by turning on the green LED 43 of the display device 70 when the front pickup 6 is selected, the front pickup 6 that has been selected and is in use is displayed directly. Accordingly, by visually confirming the display color, it is possible to easily and reliably confirm that the front pickup 6 has been selected.

Moreover, because the display portion 71B of the light guiding body 71 occupies a wide display area that surrounds the entire perimeter of the front pickup 6, it is possible to easily confirm which pickup is selected even during a performance outdoors or on stage where the illumination is poor.

Furthermore, because the entire perimeters of the front pickup 6 and the rear pickup 7 are each illuminated, it is possible to improve the appearance or design of the instrument during a performance.

Figure 8:
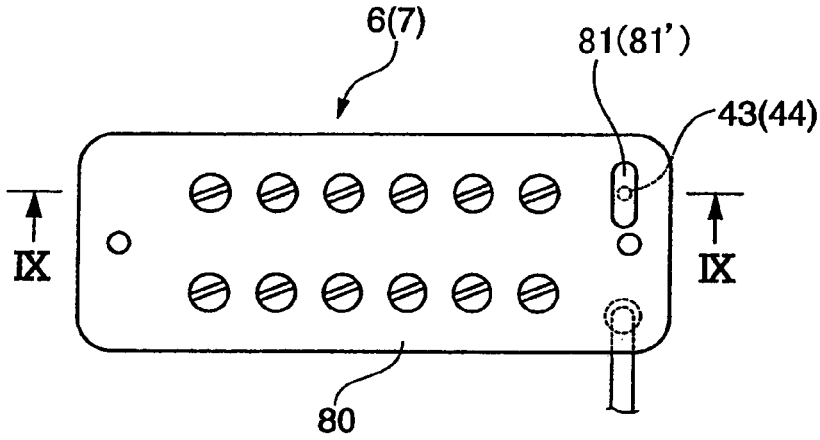
FIG. 8 is a plan view showing a front pickup according to a third embodiment of the present invention.
Figure 9:
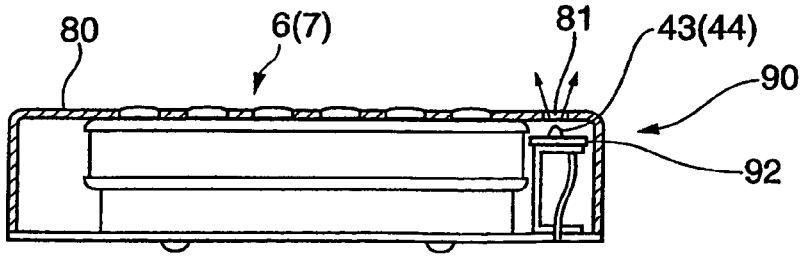
FIG. 9 is a cross-sectional view taken along a line IX-IX in FIG. 8.

FIG. 8 is a plan view of a front pickup showing a third embodiment of the present invention. FIG. 9 is a cross-sectional view taken along a line IX-IX in FIG. 8.

In this embodiment, a display device 90 is incorporated inside a case 80 of the front pickup 6. It is possible to display the fact that the front pickup 6 has been selected by means of this display device 90.

An aperture portion that is covered by a transparent plate 81 is formed at a first string side end portion of a top surface of the case 80, and the display device 90 is incorporated on the inner side of this aperture portion.

The display device 90 is formed by an LED 43 that emits light, for example, in a green color and is packaged on a printed circuit board 92.

The rear pickup 7 has been omitted from the drawings, however, the same type of display device 90 is also incorporated in the rear pickup 7. However, the display device on the rear pickup 7 side differs in that an LED that emits light in a different color from that of the display device 90 on the front pickup 6 side, for example, a blue LED 44 is used.

In this embodiment as well, because the plate 81 is illuminated in a green color by the turning on of the green LED 43 when the front pickup 6 is being used, it is possible to confirm that the front pickup 6 has been selected by visually confirming that the plate 81 is displayed in a green color. Note that the same applies for the rear pickup 7. If, in this manner, respective display devices are provided in each of the pickups so that it is possible to visually confirm which pickup has been selected, then it is not essential to employ different color displays, and it is possible to provide displays using the same color (i.e., monochrome).

Here, in each of the above described embodiments, examples are given in which the present invention is applied to an electric guitar that is provided with two types of pickup, namely, the front and rear pickups 6 and 7. However, the present invention can also be applied to electric guitars that are provided with three types of pickup, namely, a front pickup, a center pickup, and a rear pickup. In this case, either a display device provided with an LED that emits a different color from the others may be provided in each pickup, or display devices that are provided with two types of LED that each emit a different color may be provided in operating part such as a selector, volume, and tone. Note that the LED that are used are not limited to those that emit green or blue light, and other LED may be used such as those that emit red or yellow light.

Moreover, in FIG. 3, a structure is employed in which the entire perimeter of the dial 32 is displayed by the display portion 34B of the light guiding body 34, while, in FIG. 7, a structure is employed in which the entire perimeter of the front pickup 6 is displayed by the display portion 71B of the light guiding body 71, however, it is also possible for only a portion thereof to be displayed, or for the operating element itself to be made to emit light from an LED, or for a ring-shaped light guiding body to be provided in the entire operating element.

Furthermore, examples are described in which LEDs are used as light sources for the display devices 40, 70, and 90 in each of the embodiments. However, the present invention is not limited to this structure, and it is also possible to use a color liquid crystal panel 34B', 71B' and 81' (in FIGS. 2, 7 and 8, respectively) and to switch the color displayed thereon in accordance with the selection of the pickups 6 and 7. In the case of LEDs, it is necessary to use two types of LED that each emit light in a different color, however, if a color liquid crystal panel is used, the advantage is obtained that it is possible to switch between a variety of colors using a single panel.

The present invention can be applied to electric stringed instruments other than an electric guitar such as, for example, an electric bass guitar.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as limited by the foregoing description and is only limited by the scope of the appended claims.

What is claimed is:

1. An electric stringed instrument comprising:

a plurality of pickup devices which detect vibrations from respective strings and convert the vibrations into electric signals; and a display device which includes a plurality of light sources each emitting a different color light associated with each of said plurality of pickup devices to display a selection state of said plurality of pickup devices; and wherein said light sources are LEDs;

said display device further includes a light guiding body that has a display portion provided on a perimeter of an operating part, the light from said LED being guided to said display portion; and said operating part is at least one of a pickup device selecting control, a volume adjusting control, and a tone adjusting control.

2. An electric stringed instrument comprising:

a plurality of pickup devices which detect vibrations from respective strings and convert the vibrations into electric signals; and a display device which includes a color liquid crystal panel displaying a different display color associated with each of said pickup devices to display a selection state of said pickup devices; and wherein said color liquid crystal panel is provided on said pickup device and displays a different color.

3. The electric stringed instrument according to claim 2, wherein said color liquid crystal panel is provided on a perimeter of an operating part, said operating part being selected from the group consisting of said plurality of pickup device selecting control, a volume control and a tone adjustment control.

4. An electric stringed instrument comprising:

a plurality of pickup devices which detect vibrations from respective strings and convert the vibrations into electrical signals; and a display device which includes a color liquid crystal panel displaying a different display color associated with each of said pickup devices to display a selection state of said pickup devices; and wherein said color liquid crystal panel is provided on the perimeter of an operating part; and the operating part is at least one of a pickup device selecting control, a volume adjusting control, and a tone adjusting control.

* * * * *